US009282777B2

(12) United States Patent
Diakite

(10) Patent No.: US 9,282,777 B2
(45) Date of Patent: Mar. 15, 2016

(54) COMPRESSION MOBILE POCKET FOR GARMENTS

(71) Applicant: David Diakite, West Hollywood, CA (US)

(72) Inventor: David Diakite, West Hollywood, CA (US)

( * ) Notice: Subject to any disclaimer, the term of this patent is extended or adjusted under 35 U.S.C. 154(b) by 0 days.

(21) Appl. No.: 14/489,471

(22) Filed: Sep. 18, 2014

(65) Prior Publication Data

US 2015/0074866 A1 Mar. 19, 2015

Related U.S. Application Data

(60) Provisional application No. 61/879,434, filed on Sep. 18, 2013.

(51) Int. Cl.
*A41D 27/20* (2006.01)
*A41D 1/00* (2006.01)

(52) U.S. Cl.
CPC ..... *A41D 27/205* (2013.01); *A41D 27/20* (2013.01); *A41D 27/208* (2013.01); *A41D 1/005* (2013.01)

(58) Field of Classification Search
CPC ..... A41D 27/20
USPC ..... 2/69, 247, 249–254, 94, 108, 115
See application file for complete search history.

(56) References Cited

U.S. PATENT DOCUMENTS

| | | | | |
|---|---|---|---|---|
| 4,825,471 | A * | 5/1989 | Jennings | 2/94 |
| 4,876,724 | A * | 10/1989 | Suzuki | 381/385 |
| 4,899,395 | A | 2/1990 | Spector | |
| 6,832,712 | B2 | 12/2004 | Turner | |
| 7,992,225 | B2 * | 8/2011 | Demus | 2/247 |
| 8,321,964 | B2 | 12/2012 | Gernes | |
| 8,549,670 | B2 * | 10/2013 | Demus | 2/247 |
| 2006/0026735 | A1 | 2/2006 | Kensic | |
| 2009/0320183 | A1 | 12/2009 | Riney | |
| 2012/0272433 | A1 | 11/2012 | Silver | |

* cited by examiner

*Primary Examiner* — Tejash Patel
(74) *Attorney, Agent, or Firm* — Daniel Boudwin; Global Intellectual Property Agency, LLC

(57) ABSTRACT

Disclosed is a waterproof compression pocket for a garment. The pocket includes a rectangular structure with an opening at the top end thereof. In one embodiment, the top end is adapted to provide a waterproof seal to protect the contents therein from moisture. In another embodiment, the pocket may further include a waterproof lining that can be sealed to prevent permeation of water or moisture. The pocket is adapted to snugly hold contents therein so as to prevent the contents from falling out. Additionally, the pocket is preferably configured to hold a hand held electronic device therein. The pocket also includes a conductive, transparent window that allows a wearer to view the contents of the pocket and to utilize a touch screen of the electronic device held in the pocket.

5 Claims, 4 Drawing Sheets

COMPRESSION MOBILE POCKET FOR GARMENTS

CROSS REFERENCE TO RELATED APPLICATION

This application claims the benefit of U.S. Provisional Application No. 61/879,434 filed on Sep. 18, 2013. The above identified patent application is herein incorporated by reference in its entirety to provide continuity of disclosure.

BACKGROUND OF THE INVENTION

1. Field of the Invention

The present invention relates to a waterproof compression pocket for holding personal items. More specifically, the present invention pertains to an improved waterproof compression pocket that is incorporated into various types of athletic garments, and in one embodiment, configured to hold a hand held electronic device therein. The pocket includes a waterproof closure seal and a transparent window for viewing and controlling the touch screen of the electronic device. Thus, the present invention is suitable for wear during various physical activities, including water-related activities.

Many different garments often do not have adequate and convenient pockets. This is particularly true for athletic garments. Athletic garments generally do not comprise pockets, or only comprise small pockets that are not convenient and suitable for holding and carrying personal items such as hand held electronic devices, keys, wallets, and the like.

Some individuals utilize bags to hold and carry personal items, or carry personal items in their hands. However, it can be impracticable and uncomfortable to carry personal items in a bag, especially when an individual is engaged in a physical activity. Additionally, individuals can risk losing or damaging personal items when carrying it in their hands. Thus, a device that enables individuals to hold and carry personal items close to their person in a secure, hands-free manner is desired.

The present invention relates to a waterproof compression pocket that can be incorporated into a garment. In a preferred embodiment, the pocket is constructed to hold a hand held electronic device, and is incorporated into an athletic garment. The pocket is preferably composed of waterproof compression fabric material. In this way, the pocket is adapted to hold its contents close to the wearer's body. This is particularly advantageous when the wearer is engaged in a physical activity such as playing sports. The pocket comprises an opening with a waterproof closure seal to prevent water or moisture from permeating therethrough. Alternatively, the present invention comprises a waterproof lining with a waterproof closure seal, wherein the lining is disposed within the interior volume of the pocket. Thus, the present pocket is also suitable for use when the wearer is engaged in a water-related activity.

The pocket in either embodiments may be affixed to the exterior of a garment, and comprise a transparent window for viewing the contents of the pocket. The transparent window is composed of conductive material so that the wearer can utilize a touch screen of the electronic device enclosed therein. The pocket further comprises a slit or a small opening for receiving a cord of the electronic device therethrough. For example, the slit may be used to connect a headphone wire to the electronic device so that the wearer can listen to the device while wearing the garment.

2. Description of the Prior Art

Devices have been disclosed in the prior art that relate to athletic garments with interior pockets. These include devices that have been patented and published in patent application publications. Some of these devices disclose a garment with interior pockets that are configured to be positioned against the body of a wearer. Other devices disclose a waterproof storage pocket that may be used on a pair of pants. These devices, however, do not disclose a compression pocket that is installed on a garment, wherein the pocket is waterproof and is configured to store a hand held electronic device therein. The foregoing is a list of devices deemed most relevant to the present disclosure, which are herein described for the purposes of highlighting and differentiating the unique aspects of the present invention, and further highlighting the drawbacks existing in the prior art.

One such device, U.S. Pat. No. 8,321,964 to Gernes discloses a garment with a pocket, and in particular, an undergarment with a pocket on the exterior thereof. The pocket is constructed to store small or flat objects in a discreet manner. Similarly, U.S. Pat. No. 4,899,395 to Spector discloses pockets for concealing a small item, wherein the pockets are only accessible to the wearer. The foregoing devices, however, do not disclose a compression pocket that is waterproof. The present invention provides a pocket that is composed of waterproof compression material. Additionally, the pocket of the present is dimensioned to hold a hand held electronic device therein. Thus, the devices of Gernes and Spector do not disclose waterproof compression pockets for garments.

Similarly, U.S. Published Patent Application Number 2006/0026735 to Kensic discloses a shirt with inside pockets and outside pockets. The inside pockets and the outside pockets directly align so that the inside pockets are substantially a reflection of the outside pockets. Though the present invention discloses a pocket that can be located on the exterior or the interior of a garment, the pocket of the present invention is composed of waterproof and compression material, unlike the device of Kensic.

U.S. Published Patent Application Number 2009/0320183 to Riney discloses a breast pocket adapted for holding a music player therein. The device of Riney discloses a conventional pocket construction with a transparent outer surface to allow the user to see the music player held therein. The device of Riney, however, is limited to pockets that are disposed on a shirt. Furthermore, the device of Riney does not protect the music player from water or moisture. In contrast, the present invention discloses a waterproof pocket so as to enable the wearer to engage in water-related activities while storing an electronic device in the pocket.

U.S. Published Patent Application Number 2012/0272433 to Silver discloses a pocket for pants, wherein the pocket can expand outward by means of elastic or the like. In this way, the pocket can be used to store bulky items that do not lie flat against the user when placed in the pocket. In contrast, the present invention comprises a compression pocket to keep items held therein close to the user. Thus, the device of Silver is inoperable to secure items in a similar manner.

Finally, U.S. Pat. No. 6,832,712 to Turner discloses a belt with a waterproof compartment. The compartment comprises a screw on cap that can be used to provide a secure seal. In this way, the interior of the compartment is prevented from exposure to moisture and other outside elements. The design and intent of the present invention, however, differ from the Turner device in that the present invention comprises a pocket that can be incorporated into a garment. In this way, the present invention eliminates the need for the wearer to don an additional accessory such as a fanny pack or a holder belt to hold personal items therein.

The devices disclosed in the prior art have several known drawbacks. These devices are limited in that none of the devices comprise a waterproof compression pocket that is incorporated into a garment, and more specifically, an athletic garment. The present invention overcomes these limitations by disclosing a pocket that is composed of compression material. Additionally, the pocket itself may be waterproof or comprise a waterproof lining in the interior volume thereof. Thus, the pocket is ideal for holding hand held electronic devices therein. The pocket further comprises a transparent window for viewing and controlling the electronic device with a touch screen. Thus, the wearer can utilize the electronic device without removing the device from the pocket while the wearer is engaged in a physical activity or a water-related activity.

It is therefore submitted that the present invention is substantially divergent in design elements from the prior art, and consequently it is clear that there is a need in the art for an improvement to pockets for athletic garments. In this regard, the instant invention substantially fulfills these needs.

SUMMARY OF THE INVENTION

In view of the foregoing disadvantages inherent in the known types of pockets for athletic garments now present in the prior art, the present invention provides a new and improved waterproof compression pockets for garments wherein the same can be utilized for storing and carrying hand held electronic devices and other personal items.

It is therefore an object of the invention to provide a new and improved waterproof compression pocket for garments that has all of the advantages of the prior art and none of the disadvantages.

Another object of the present invention is to provide a new and improved waterproof compression pocket for garments that is composed of waterproof material to allow the wearer to engage in water-related activities without damaging items held in the pocket.

Yet another object of the present invention is to provide a new and improved waterproof compression pocket for garments that is composed of compression material to hold items held therein close to the wearer's body.

Yet another object of the present invention is to provide a new and improved waterproof compression pocket for garments having a waterproof lining in the interior thereof.

Yet another object of the present invention is to provide a new and improved waterproof compression pocket for garments having a transparent window for viewing and controlling an electronic device held therein.

Still yet another object of the present invention is to provide a new and improved waterproof compression pocket for garments that can be affixed to the exterior or the interior of various types of garments such as shirts or undergarments.

Still yet another object of the present invention is to provide a new and improved waterproof compression pocket for garments having a slit for a headphone wire.

Still yet another object of the present invention is to provide a new and improved waterproof compression pocket for garments wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
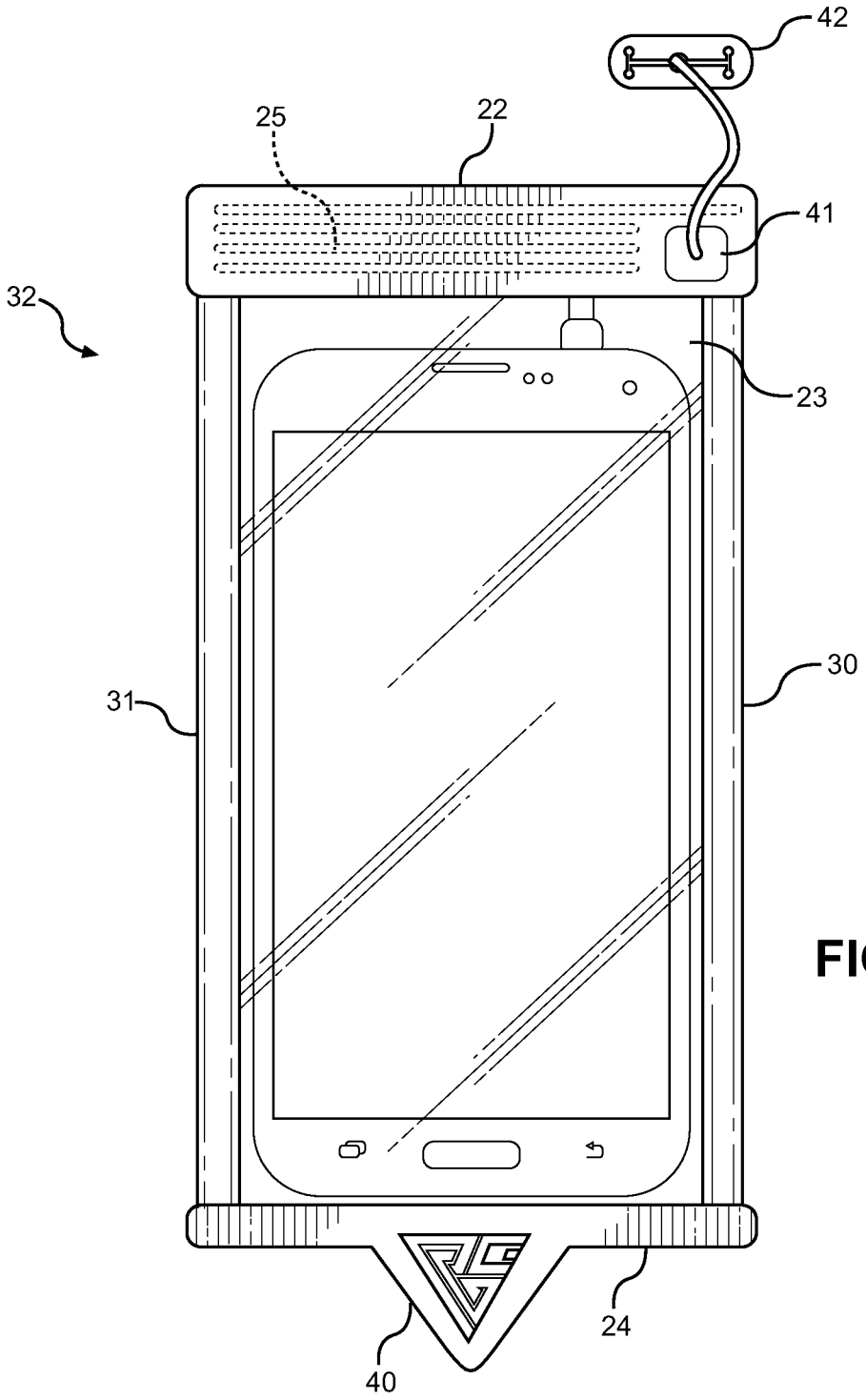
FIG. 1 shows a front view of the pocket of the present invention.

References are made herein to the attached drawings. Like reference numerals are used throughout the drawings to depict like or similar elements of the waterproof compression pockets for garments. For the purposes of presenting a brief and clear description of the present invention, the preferred embodiment will be discussed as used to store and carry hand held electronic devices and other personal items. The figures are intended for representative purposes only and should not be considered to be limiting in any respect.

Referring now to FIG. 1, there is shown a front view of the pocket of the present invention. The present invention comprises a pocket 32 that is substantially rectangular in shape. In one embodiment, the pocket 32 comprises two juxtaposed sheets of material of substantially equal dimension and shape. The two sheets of material are directly aligned and molded together or sewn together about the edges thereof to form a closed first end 30 opposite a closed second end 31, and a closed bottom end 24 opposite an open top end 22, defining an interior volume therein. Preferably, the interior volume of the pocket 32 is dimensioned to fit various types of hand held electronic devices therein. The pocket 32 may be preferably composed of waterproof or water resistant compression material such as a blend of neoprene, polyester, or another elastic material, including spandex. In this way, the present invention is ideal for use with athletic garments.

In one embodiment, the open top end 22 may comprise waterproof closure seal or fasteners 25 thereon for closing and opening the pocket 32. Without limitation, the fasteners 25 may comprise a snap tight top, hook and loop fasteners, a zipper, snap fasteners, or the like. The fasteners 25 substantially span the entire length of the top end 22 of the pocket 32 in order to prevent smaller items from falling out of the pocket 32. The top end 22 further comprises a corner opening 41. When an electronic device is held within the interior volume of the pocket 32, the corner opening 41 may be used to receive a cord of the electronic device therethrough. In this way, the wearer can connect a headphone wire or a similar cord to the electronic device while the device is held within the pocket 32. It is contemplated that the corner opening 41 may comprise a gasket so as to provide a seal around the cord to prevent permeation of moisture or other elements. The corner opening 41 may be used with a reinforced secondary opening 42 that is disposed on the garment on which the pocket 32 is installed.

Alternatively, the pocket 32 may further comprise a waterproof lining in the interior volume thereof. The waterproof lining may be composed of plastic, nylon, polyester blend, or other suitable material. The lining is adapted to fit in the interior volume of the pocket 32. Similar to the pocket 32, lining comprises a closed first end opposite a closed second end, and a closed bottom end opposite an open top end, forming an interior volume to hold various items therein. The closed ends of the lining may be heat welded. The top end may comprise waterproof closure seal, such as a zip-lock enclosure, with a rubber seal to completely close the lining to prevent permeation of water, moisture, or other elements. In this way, the present invention may be worn when the wearer is engaged in water-related activities.

The pocket further comprises a front side and a back side. The front side comprises a transparent window 23 to allow the wearer of the pocket to see the contents enclosed in the interior volume. The window 23 may be preferably composed of conductive, and non-insulating material, such as plastic, urethane, vinyl, or the like. In this way, the window 23 allows the electronic device in the pocket to create an electromagnetic field and detect movement based on the disturbance of the electromagnetic field, which is created by the wearer's fingers as the wearer moves his or her finger across the window 23. Thus, the wearer can utilize the touch screen of the electronic device without removing it from the pocket.

In some embodiments, the pocket may further comprise a tab 40 thereon. The tab 40 comprises an upper end and a lower end, and in the illustrated embodiment, the tab 40 is substantially triangular in shape. The tab 40 may be centrally located along the bottom end 24 of the pocket 32. The upper end of the tab 40 may be integrally formed as part of the pocket 32. Alternatively, the upper end of the tab 40 may be separate and stitched to the bottom end 24 of the pocket 32. The lower end of the tab 40 may be used to tilt the pocket 32 upward to view the electronic device held therein.

Figure 2:
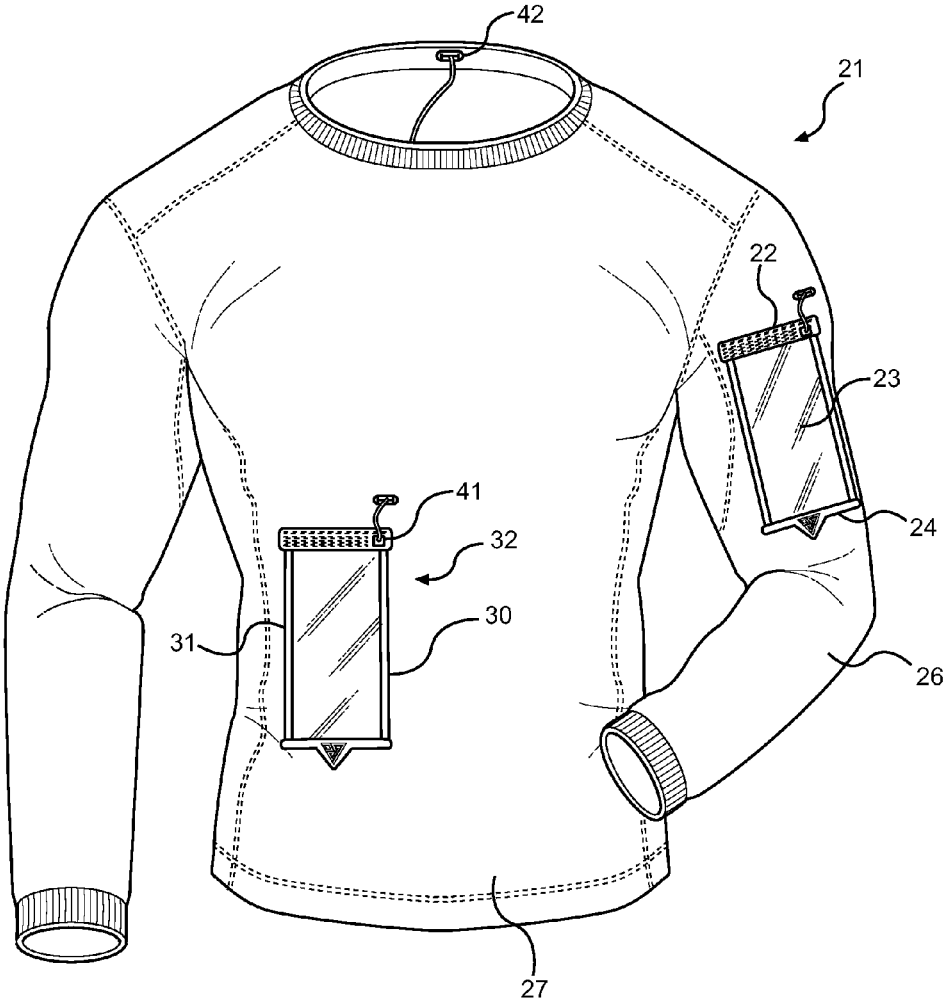
FIG. 2 shows a front view of the present invention as installed on a long-sleeve athletic garment.
Figure 3:
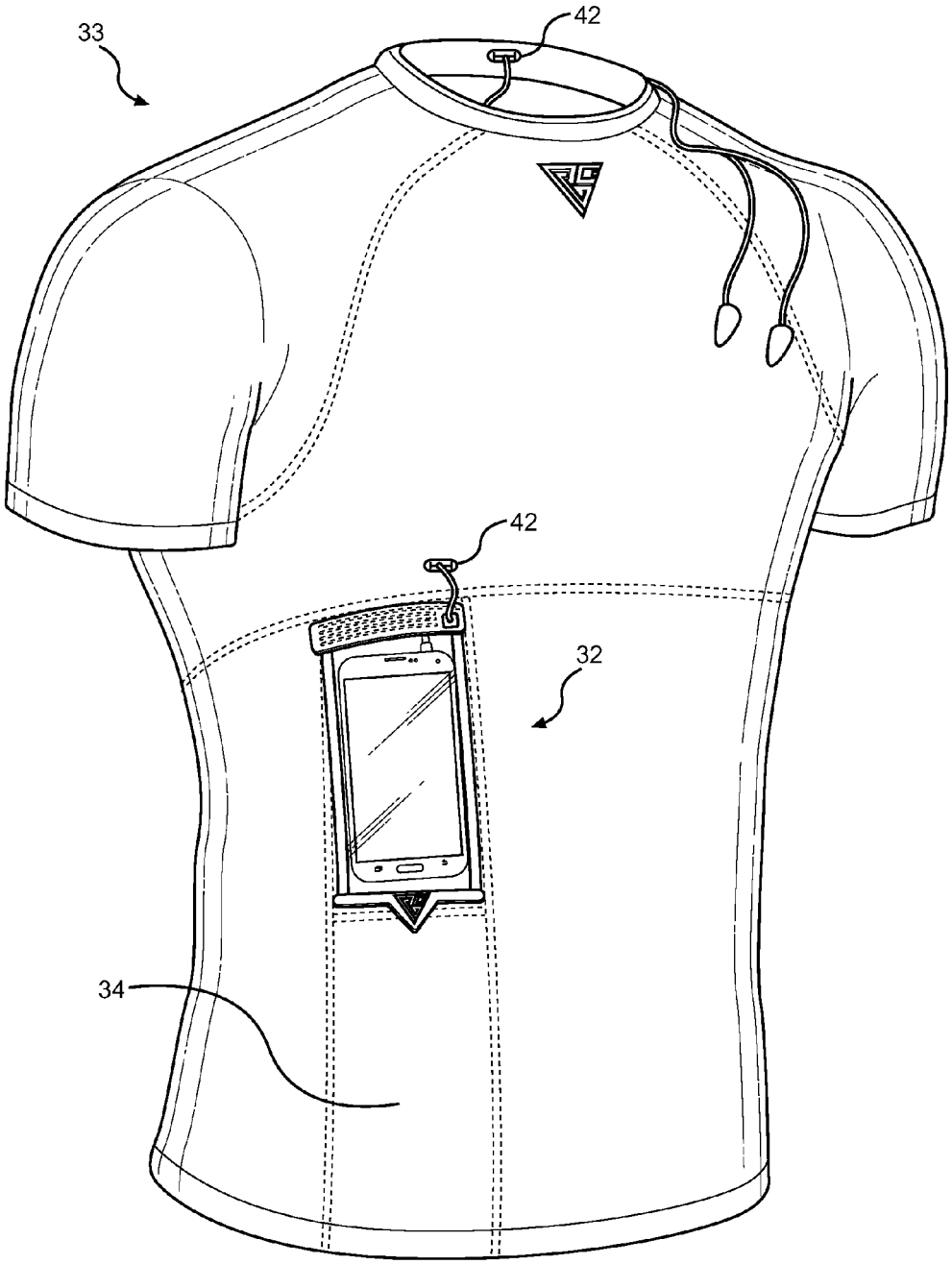
FIG. 3 shows a perspective view of the present invention as installed on a short-sleeve athletic garment.

Referring now to FIGS. 2 and 3, there are shown views of the present invention as installed on athletic shirts. The shirts comprise sleeves, a torso area having a front side, a back side, an open bottom, and a neck opening. The athletic shirts are composed of waterproof compression material that repels water. Alternatively, the shirts may be composed of moisture wicking fabric material that allows quick evaporation of moisture. The back side of the pocket 32 is affixed to the exterior of the shirts 21, 33 so that the pocket 32 is readily accessible to the wearer of the shirts 21, 33. The back of the pocket 32 may be sewn onto the shirts 21, 33 or permanently affixed thereto via heat activated adhesives.

In some embodiments, the pocket 32 may comprise one sheet of material that is attached to the garment. The sheet of material may be sewn to the exterior of the garment to form a closed first end 30 opposite a closed second end 31, a closed bottom end 24 opposite an open top end 22. Accordingly, the front side of the pocket 32 is the sheet of material and the back side of the pocket 32 is the exterior of the garment on which it is installed. In this way, the interior volume is formed between the exterior of the garment and the interior of the front side of the pocket 32. The top end 22 may be closed or opened via fasteners that are located on the interior of the top end 22 and the garment. For instance, the interior of the top end 22 may comprise snap tight top along the length thereof. In the illustrated embodiment, the top end 22 further comprises a slit or a corner opening 41 that is adapted to receive a cord therethrough.

The long-sleeve shirt 21 may comprise a first pocket 32 on the sleeve 26 and a second pocket on the front side 27 of the shirt 21, as shown in FIG. 2. The short-sleeve shirt 33 may comprise one pocket 32 on the front side 34 thereof, as shown in FIG. 3. In other embodiments, however, the pocket 32 may be located anywhere on the garment where it is accessible to the wearer, and preferably where the window 23 is visible to the wearer. Because the pocket 32 and the shirts 21, 33 are composed of compression fabric material, items stored in the pocket 32 are held close to the wearer's body.

The present invention further comprises a reinforced secondary opening 42 that is located near the top end of the pocket 32 on the front side 27, 34 of the shirt 21, 33. The opening 42 comprises a slit that is die cut. The reinforced secondary opening 42 may be used to thread the cord of the electronic device therethrough so that the cord is extended along the inside of the shirt and is prevented from entangling. In a preferred embodiment, a second reinforced secondary opening 42 may be located near the collar or the neck opening of the shirt 33 so that the headphones of the cord can come back out of the shirt to be positioned near the wearer's ears.

Figure 4A:
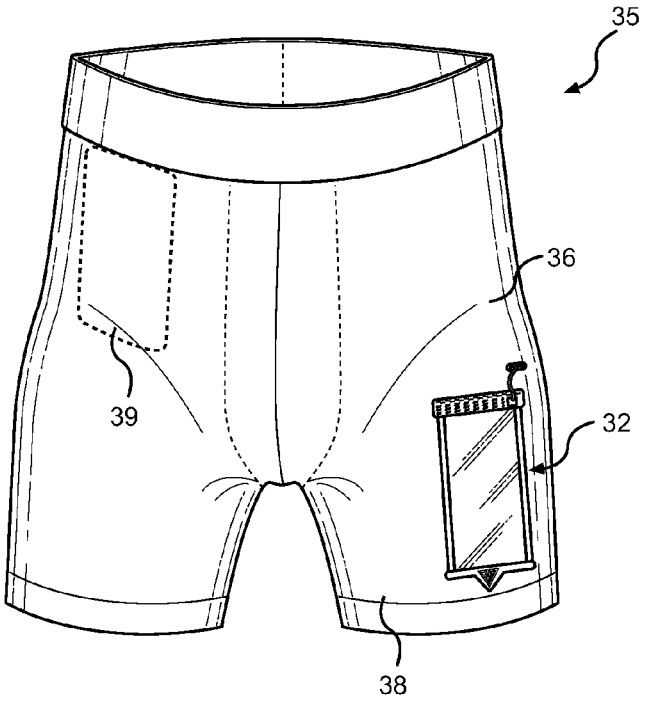
FIG. 4A shows a view of the present invention as installed on an undergarment.
Figure 4B:
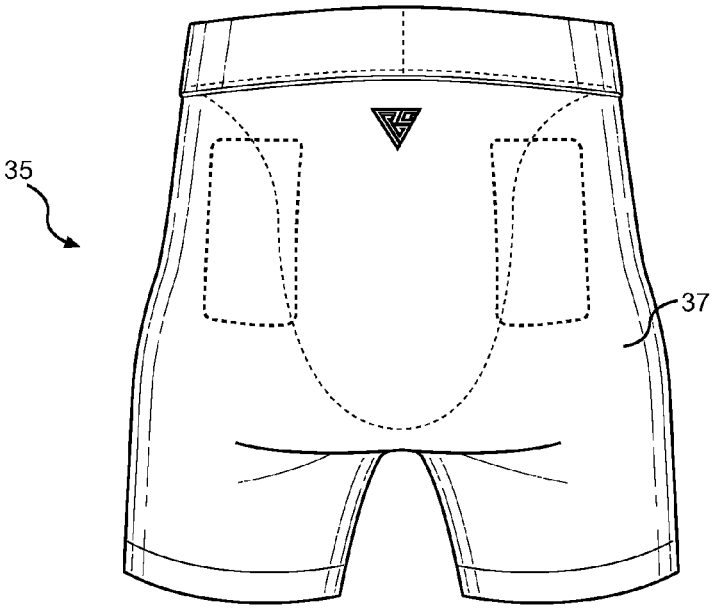
FIG. 4B shows another view of the present invention as installed on an undergarment.

Referring now to FIGS. 4A and 4B, there are shown views of the present invention as installed on an undergarment 35 for males. The undergarment 35 comprises a waist band, a front side 36 connected to a back side 37, and a pair of leg portions 38 with an opening for receiving legs therethrough. The undergarment 35 further comprises a pocket 32 on the exterior of one of the leg portion 38, and at least one interior pocket 39. The interior pockets 39 are of substantially the same construction as the pockets 32 disposed on the exterior of the undergarment. Accordingly, the interior pockets 39 are also waterproof and are composed of compression material. However, the interior pockets 39 do not comprise a transparent window because the interior pockets 39 are not readily viewable to the wearer when the undergarment 35 is worn.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A waterproof compression pocket, comprising:

a waterproof pocket having a closed first end opposite a closed second end, a closed bottom end opposite an open top end, defining an interior volume adapted to hold a hand held electronic device therein;

said open top end of said pocket having a waterproof closure to open and close said pocket and that is adapted to provide a waterproof seal;

the waterproof pocket attached to a shirt, the shirt having sleeves, a torso area, and a neck opening;

a reinforced secondary opening on the neck opening, the reinforced secondary opening configured to receive a cable therethrough;

a transparent window on a front side of said pocket.

2. The waterproof compression pocket of claim 1, wherein said window is composed of a conductive material that allows usage of a touch screen of said hand held electronic device.

3. The waterproof compression pocket of claim 1, wherein said open top end of said pocket comprises a corner opening for receiving a cord of said hand held electronic device therethrough.

4. The waterproof compression pocket of claim 1, further comprising:

a tab that is centrally located on said bottom end of said pocket.

5. A waterproof compression pocket, comprising:

a waterproof pocket having a closed first end opposite a closed second end, a closed bottom end opposite an open top end, defining an interior volume adapted to hold a hand held electronic device therein;

said open top end of said pocket having a waterproof closure to open and close said pocket and that is adapted to provide a waterproof seal;

the waterproof pocket attached to a shirt, the shirt having sleeves, a torso area, and a neck opening;

a reinforced secondary opening on the torso area;

a transparent window on a front side of said pocket.

* * * * *